United States Patent [19]

Bemis et al.

[11] 4,265,552

[45] May 5, 1981

[54] RIBBON DRIVE MECHANISM FOR HIGH SPEED PRINTER

[75] Inventors: John D. Bemis; Willie Goff, Jr., both of Austin, Tex.

[73] Assignee: International Business Machines Corporation, Armonk, N.Y.

[21] Appl. No.: 234

[22] Filed: Jan. 2, 1979

[51] Int. Cl.[3] ..... BA1J 33/14

[52] U.S. Cl. ..... 400/236; 400/208; 400/217

[58] Field of Search ..... 400/206, 208, 211, 216, 400/216.2, 217, 219, 223, 236; 242/71.2, 75.1, 192, 197, 198, 199, 200; 354/275; 206/387; 226/171, 172

[56] References Cited

U.S. PATENT DOCUMENTS

| | | | |
|---|---|---|---|
| 1,046,711 | 12/1912 | Alexander | 400/236 X |
| 3,084,880 | 4/1963 | Grant et al. | 242/200 |
| 3,305,186 | 2/1967 | Burdorf et al. | 242/192 |
| 3,383,061 | 5/1968 | Thompson et al. | 242/200 |
| 3,802,644 | 4/1974 | Maiershofer | 242/192 |

FOREIGN PATENT DOCUMENTS

| | | | |
|---|---|---|---|
| 698262 | 11/1930 | France | 242/192 |

OTHER PUBLICATIONS

IBM Technical Disclosure Bulletin, "Ribbon Drive", Darwin, vol. 19 No. 4, Sep. 1976, pp. 1407-1408.

*Primary Examiner*—Ernest T. Wright, Jr.
*Attorney, Agent, or Firm*—J. B. Kraft

[57] ABSTRACT

In a high speed printer, apparatus is provided for rotatably driving a ribbon take-up reel and a ribbon supply reel, each reel being adapted to support a portion of an inventory of ribbon running from the supply reel to the take-up reel at a constant speed differential between reels. This apparatus comprises a first inelastic drive belt for peripherally non-slip driving the ribbon portion on the take-up reel and a second inelastic drive belt unattached to the first drive belt for peripherally non-slip driving the ribbon portion on the supply reel. Means are provided for driving the first belt at a constant selected speed and drive coupling means provided which are non-slip driven by the first belt and are for non-slip driving the second belt at a constant speed which is slower than the first belt. In this manner, the web or ribbon between the supply reel and the take-up reel is maintained under a constant uniform strain level.

6 Claims, 4 Drawing Figures

RIBBON DRIVE MECHANISM FOR HIGH SPEED PRINTER

DESCRIPTION

BACKGROUND OF THE INVENTION

1. Field of the Invention

This invention relates to impact printers. More specifically, it relates to a ribbon drive mechanism which is utilizable for such impact printers.

2. Description of Prior Art

With the development of the printer field in the direction of high speed impact printers producing high quality printing suitable for correspondence at high speed in the order of 60 cycles per second, new needs have arisen with respect to printer ribbon structures and drive mechanisms.

Because of the high throughput of such printer apparatus and the consequently high volume of printed characters, the art has had to provide a ribbon which is of relatively low cost but yet provides high quality printing. Because of the difficulty in meeting these requirements with the more traditional fabric base or carbon film ribbons, the art has been working with a more recent type of ribbon which is a case matrix of a plastic such as nylon containing liquid ink. While such ribbon structures appear to provide the combination of high quality printing and low cost, they are highly distortable and fragile. Further, they are sensitive to high temperature ad high humidity. For example, at temperatures in the order of 25° C. and 80% relative humidity, as little as 30 grams of ribbon tension may cause objectionable yielding and frequent breakage of a cast matrix type of ribbon which is in the order of 0.6 cm. wide.

These problems become particularly acute in high speed "daisy wheel" printers. Designers of such impact printers have been attempting to minimize the flight path of the selected character petal, i.e., the distance the petal must travel in driving the ribbon against the sheet in order to maximize the speed of the printers. In this connection, distances in the order of a tenth of an inch between the face of the printer wheel petal and the platen would not be unreasonable in high speed printers. Since the ribbon, the cardholder, and the paper all must fit and be translationally movable within this limited space, problems of maintaining very close tolerances between these elements are presented. Because of these close tolerances, the ribbon must be kept at a very shallow angle to the paper surface. Thus, the ribbon tension required to release the ribbon from the paper following impact is greater than that encountered in conventional typeball machines having higher allowable peel angles. In addition, in printers employing "daisy wheels", the physical arrangement of components is such that there is a longer expanse (print span) of unsupported ribbon along the printing surface. This gives rise to greater ribbon tension requirements.

Thus, in implementing such highly fragile and easily distortable ribbon to the requirement of the high speed impact printing art, substantial problems were involved. Such problems included how to maintain a constant and uniform tension required because of the close tolerances in the impact areas and the tensions required to keep the ribbon relatively taut adjacent to the daisy wheel while at the same time driving without substantially distorting or breaking the highly distortable fragile ribbon.

BRIEF DESCRIPTION OF PRESENT INVENTION

It is the primary object of the present invention to provide means for driving a highly fragile and distortable ribbon or web.

It is another object of the present invention to provide means for driving a highly fragile and distortable ribbon or web while maintaining the same under a constant uniform strain.

It is a further object of the present invention to provide means for driving highly fragile and distortable ribbon used in high speed impact printers while maintaining the same under a constant uniform strain.

It is yet another object of the present invention to provide apparatus for driving a highly fragile and distortable ribbon or web contained in the cartridge while maintaining the same under a constant uniform strain.

The present invention accomplishes the above objects by providing apparatus for rotatably driving a take-up reel and a supply reel, each reel adapted to support a portion of an inventory of a web member running from the supply reel to the take-up reel at a constant speed differential between the reels. The maintenance of this constant speed differential irrespective of the amount of ribbon on either the supply or take-up reel provides this constant uniform strain on the ribbon. The apparatus comprises a first inelastic drive belt for peripherally non-slip driving the web portion of the take-up reel and a second inelastic drive belt unattached to the first drive belt for peripherally non-slip driving the web portion on the supply reel. The apparatus further includes means for driving the first belt at a constant selected speed and drive means non-slip driven by the first belt for non-slip driving the second belt at a constant speed which is slower than the first belt. Consequently, the web member between the supply reel and the take-up reel is maintained under a constant strain. The inelastic drive belt should of course be less elastic than the web or ribbon member.

BRIEF DESCRIPTION OF THE DRAWING

Referring now to the drawing, wherein a preferred embodiment of this invention is illustrated, and wherein like reference numerals are used throughout to designate like parts, the following is a description of the figures.

BRIEF DESCRIPTION OF THE PREFERRED EMBODIMENT

Figure 1:
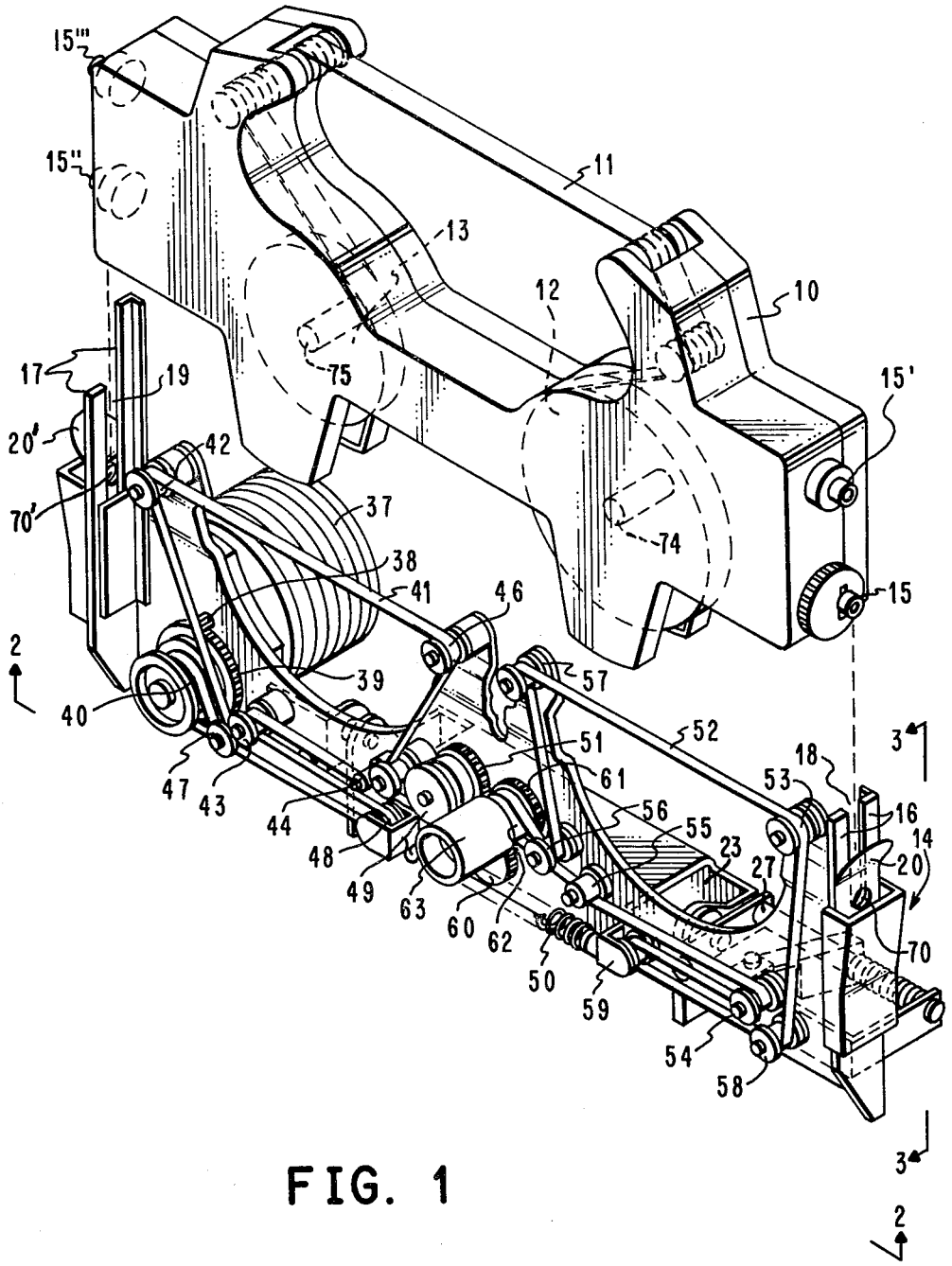
FIG. 1 shows a partial fragmentary perspective view of the ribbon drive mechanism of the present invention together with an operatively associated ribbon cartridge to be driven by the present drive mechanism.
Figure 4:
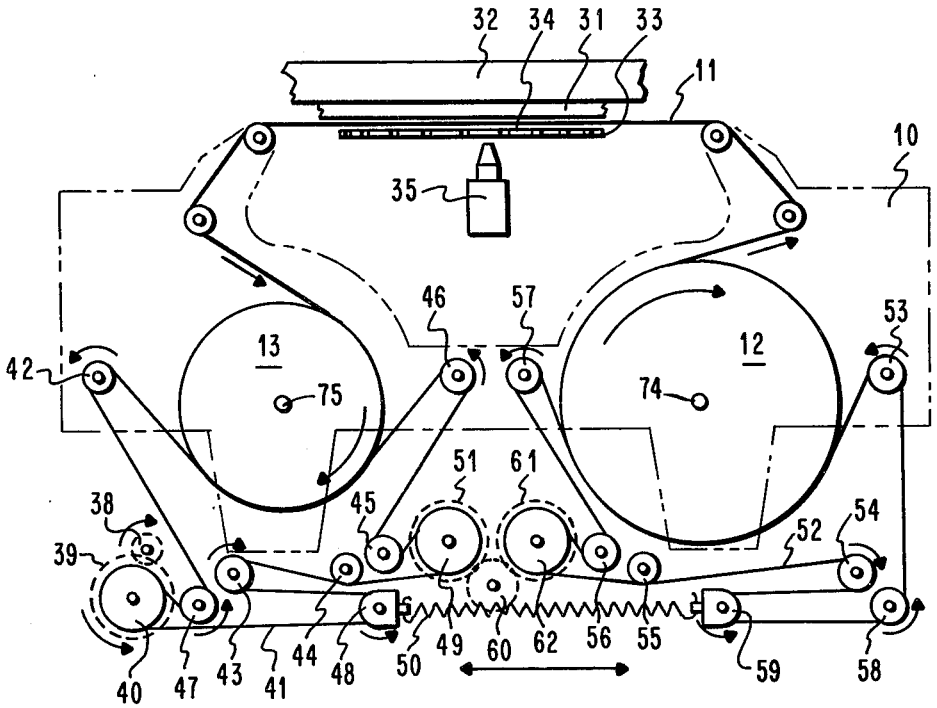
FIG. 4 is a generalized plan view of diagrammatic form of the drive and ribbon mechanism of FIG. 1 associated with a missile type of daisy wheel high speed printer drawn to illustrate the relative movement of the various components during a ribbon driving operation.

With reference to FIGS. 1 and 4, there will now be described the drive mechanism of the present invention associated with a ribbon cartridge of the type described in co-pending patent application Reversible Ribbon Cartridge, J. D. Bemis et al, Ser. No. 000,233, filed on Jan. 2, 1979, the same date as the present application and assigned to a common assignee.

Figure 2:
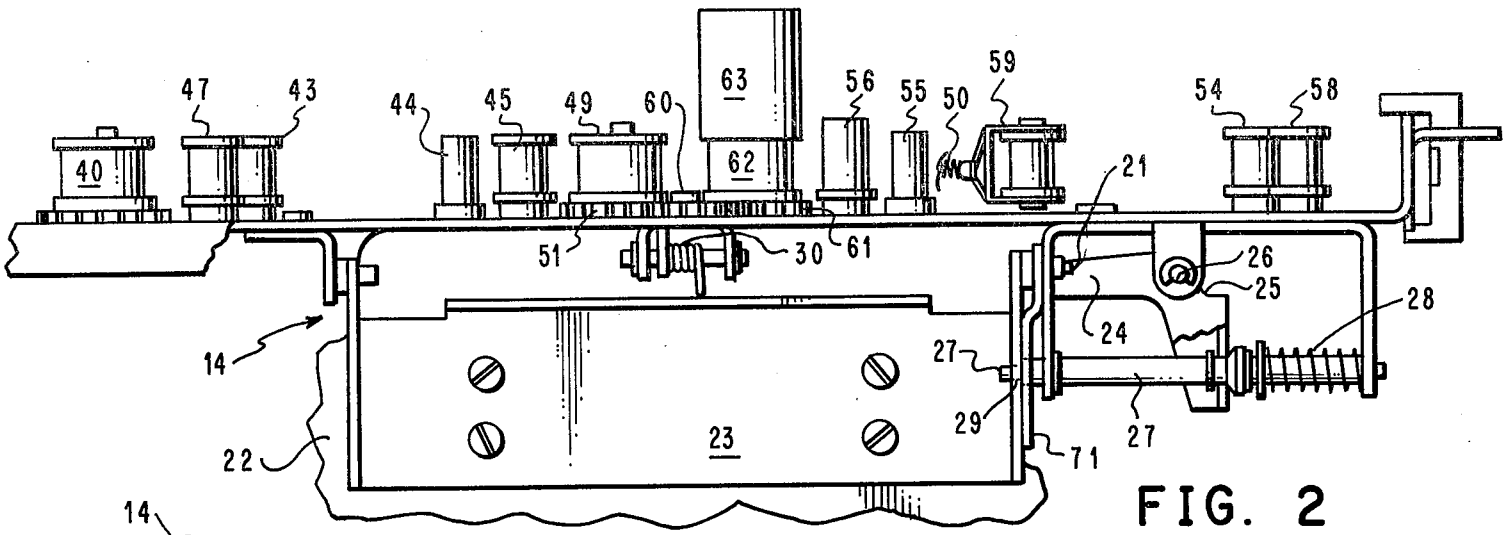
FIG. 2 is a partial front view of the apparatus of FIG. 1 taken in substantially the direction indicated by arrows 2—2 when the drive mechanism of FIG. 1 is in the horizontal position.
Figure 3:
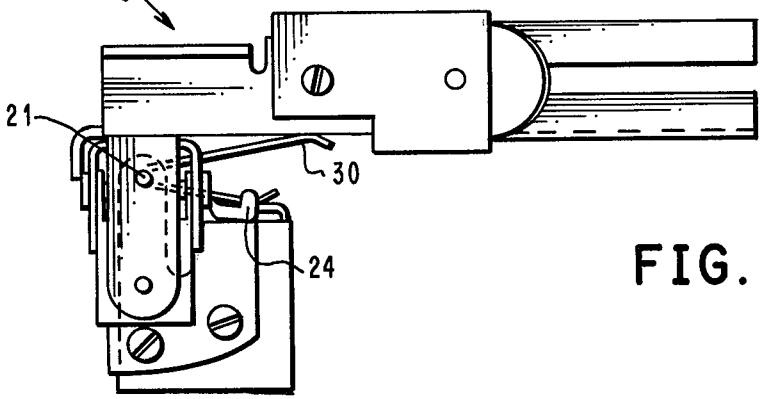
FIG. 3 is a fragmentary side view of the apparatus of FIG. 1 taken along lines 3—3 also when this apparatus is in the horizontal position.

Only that portion of a high speed printer apparatus necessary to illustrate the present invention is diagrammatically shown (FIG. 4). With reference to FIGS. 4 and 1, the ribbon 11 is contained in a cartridge 10. The ribbon 11 has a portion 12 on a supply reel 74 and a portion 13 on a take-up reel 75. In FIG. 1, the ribbon cartridge 10 is shown separated from the ribbon drive mechanism 14, both being in the vertical or ribbon cartridge loading-unloading position. When loading or unloading the ribbon cartridge 10, two pairs of cartridge tenons 15, 15', 15'', and 15''' are respectively received and guided by two pairs of vertical tabs 16 and 17, respectively, in the drive mechanism 14 which define slots 18 and 19 for receiving and seating the respective ribbon tenons 15, 15', 15'', and 15''' as described in detail in the above-mentioned co-pending patent application. The tenons 15, 15', 15'', and 15''' are guided along slots 18 and 19 respectively into openings 70 and 70' so that tenons 15 and 15'' are respectively guided into openings 70 and 70' in cartridge retaining clips 20 and 20' along a path shown in dotted lines to lock the cartridge 10 into position. Spring loaded clips 20 and 20' respectively urge the openings 70 and 70' into engagement with tenons 15, 15'' to latch the cartridge 10 into position. In order to unlatch the cartridge 10, clips 20 and 20' may be manually urged away from the cartridge 10 to release the cartridge 10 from the openings 70 and 70'. The loading and unloading takes place in the vertical position shown in FIG. 1 after which the mechanism is rotated about pin 21, FIG. 2, to bring the ribbon 11 and drive mechanism 14 into the horizontal operational position shown in FIGS. 2, 3, and 4. The mechanisms for rotating the apparatus from the vertical to the horizontal positions will be hereinafter described in greater detail with respect to FIGS. 2 and 3; the ribbon drive mechanism 14 is mounted on printer carrier-frame 22 by mounting bracket 23 which is bolted on the frame 22 of the printer carrier. If it is desired to rotate the ribbon drive mechanism 15 from its horizontal position shown in FIGS. 2 and 3 to the vertical or load position, the cartridge 10 (not shown in FIGS. 2 and 3) is pressed down or rotated until it produces a downward force on arm 24 of bell crank 25. This rotates bell crank 25 about pivot 26 to move pin 27 against the force of spring 28 to thereby release pin 27 from an opening 29 in detent plate 71 mounted on bracket 23 in which pin 27 has been detented. With the detent thus released, spring 30 which urges the ribbon drive mechanism 14 counterclockwise thus forces the released drive mechanism 14 into the vertical or load-unload position shown in FIG. 1. If it is subsequently desired to return the drive mechanism 14 to the horizontal position shown in FIGS. 2 and 3, the structure may be conveniently rotated manually clockwise about pivot pin 21 against the action of spring 30 until pin 27 is once again detented in opening 29 in detent plate 71.

For convenience in description, the mechanism for loading and unloading a typical ribbon cartridge 10 with respect to the ribbon drive mechanism 14 of the present invention has been described. It should be understood that any conventional loading and unloading expedient may be used to bring the drive system of the present invention into engagement with the respective peripheries of the portions 12, 13 of a web or ribbon inventory respectively on supply and take-up reels 74, 75. Such take-up and supply reels 74, 75 may be part of an overall cartridge mechanism or merely a pair of discrete reels. The preferred embodiment of the ribbon drive apparatus which is the crux of the present invention will now be described in detail with respect to FIGS. 1 and 4. FIG. 1 shows the ribbon drive apparatus of the present invention giving structural details while FIG. 4 is an illustration to show diagrammatically the coaction of the apparatus with a conventional daisy wheel high speed printer. Referring to the FIG. 4 layout with respect to the printer apparatus, the ribbon 11 is moved past a sheet of printing medium such as paper 31 supported against a platen 32. A conventional print wheel 33 contains petals 34 each with a different character to be printed; the wheel 33 is rotatable between the ribbon 11 and impact means 35 which for purposes of this illustration is a missile type of impact means. Now with respect to the ribbon drive apparatus shown in FIGS. 1 and 4, a stepper motor 37 rotates pinion 38 in the direction shown. Pinion 38 drives gear 39 which in turn drives capstan 40 which is fixed to gear 39. Capstan 40 in turn drives take-up drive belt 41 which is guided over pulleys 42, 43, 44, 45, 46 and 47 which serve the function of guide pulleys. In addition, belt 41 is also guided over idler pulley 48 which is connected to spring means 50 to be hereinafter described and over pulley 49 which is affixed to drive gear 51.

Supply reel drive belt 52 which is made of the same relatively inelastic material as drive belt 41 is supported and guided over a series of guide pulleys 53 through 58 which correspond to pulleys 42 through 47 associated with the take-up reel drive belt 41. In addition, idler pulley 59 performs a function equivalent to idler pulley 48. Gear 51 drives idler gear 60 which in turn drives gear 61. Pulley 62 fixed to gear 61 is in turn driven and in effect provides the drive for supply reel drive belt 52. Pulleys 49 and 62 are identical except that pulley 62 which is associated with the supply reel drive belt 52 has a slightly smaller diameter than pulley 49. Thus, supply reel drive belt 52 will be driven at a speed slightly slower than take-up reel drive belt 41. Since drive belts 41 and 52, respectively drive ribbon portion 13 on take-up reel 75 and ribbon portion 12 on supply reel 74 in peripheral non-slip driving association, the ribbon 11 coming off supply reel 74 will be moving at a constant velocity which is slightly less than the ribbon 11 being wound onto take-up reel 75. This will provide a constant strain on ribbon 11 to provide a solution to the needs described hereinabove. With the arrangement shown, this velocity differential will remain constant and consequently the slight strain on the ribbon 11 will also remain constant irrespective of the size of the portion 12 of the ribbon 11 on supply reel 74 or the portion of ribbon 13 on take-up reel 75.

Since drive belts 41 and 52 are substantially inelastic, the total combined length of take-up reel drive belt 41 actually in contact with the ribbon portion 13 periphery on take-up reel 75 and supply reel drive belt 52 in actual contact with the periphery of the ribbon portion 12 on supply reel 74 will remain substantially constant irrespective of changes in the sizes of the ribbon portions 12 and 13 on these two reels 74 and 75. In this respect, spring member 50 and its associated idler pulleys 48 and 59 prevent any slack in drive belts 41 and 52 due to changes in the size of the ribbon portions 12 and 13 on reels 74 and 75. While the other pulleys are fixed, idler pulleys 48 and 59 float, i.e., do not have any fixed position so that they may shift with changes in the size of the ribbon portions 13 and 12 on the respective take-up 75 and supply reels 74. In this manner, the length of spring 50 remains constant with the position of the spring 50 shifting from left to right as shown by the arrows in order to compensate for changes in the size of the portions of ribbon 12 and 13 on the respective take-up and supply reels 75 and 74.

Should it be necessary to manually adjust the strain on the ribbon 11, knob 63 is provided for manually drawing pulley 62 and affixed gear 61 out of engagement with idler gear 60 so that supply reel drive belt 52 may act on ribbon portion 12 on supply reel 74 alone to manually adjust the tension on ribbon 11 while the position of take-up reel drive belt 41 and ribbon portion 13 on take-up reel 75 remain stationary. When the adjustment is completed, knob 63, and consequently pulley 62 and gear 61 may be moved back into operative engagement with the apparatus.

While the invention has been particularly shown and described with reference to a particular embodiment, it will be understood by those skilled in the art that various changes in form and detail may be made without departing from the spirit and scope of the invention.

What is claimed is:

1. Apparatus for rotatably driving a take-up reel and a supply reel, each reel supporting a portion of an inventory of a web member running from the supply reel to the take-up reel at a constant speed differential between said respective portions of said web member comprising:

a first inelastic drive belt for peripherally non-slip driving the web portion on said take-up reel, a second inelastic drive belt unattached to said first drive belt for peripherally non-slip driving the web portion on the supply reel, means for driving said first belt at a constant selected speed, and drive coupling means non-slip driven by said first belt for non-slip driving said second belt at a constant speed which is slower than said first belt, whereby the web member between the supply reel and take-up reel is maintained under a constant strain.

2. The apparatus of claim 1 wherein said web member is more elastic than said drive belts.

3. The apparatus of claim 2 wherein said drive coupling means are gear means having a ratio such that said second belt is driven at said slower speed.

4. The apparatus of claim 2 wherein the combined length of said first belt in contact with the periphery of said web portion on said take-up reel and of said second belt in contact with the periphery of said web portion on said supply reel remains constant irrespective of changes in the web portions on said reels, and further including an elastic member connecting said first belt to said second belt whereby the extension of said elastic member consequently by the pressure of said belts against said web portions on said take-up and supply reels remain substantially constant irrespective of changes in the web portions on said reels.

5. The apparatus of claim 4 wherein said elastic member is a linearily extendable spring.

6. The apparatus of claim 1, further including means for disengaging the driving means for said second belt from said first belt so that the strain on the web member may be manually adjusted.

* * * * *